US006808338B2

(12) United States Patent
Zingerman

(10) Patent No.: US 6,808,338 B2
(45) Date of Patent: Oct. 26, 2004

(54) METHOD AND SYSTEM FOR LIFTING OF THE MASSIVE CONSTRUCTIONS

(75) Inventor: David Zingerman, 1714 N. Ivar Ave., Apt. #803, Los Angeles, CA (US) 90028

(73) Assignee: David Zingerman, Los Angeles, CA (US)

( * ) Notice: Subject to any disclaimer, the term of this patent is extended or adjusted under 35 U.S.C. 154(b) by 0 days.

(21) Appl. No.: 10/379,780

(22) Filed: Mar. 4, 2003

(65) Prior Publication Data

US 2004/0175241 A1 Sep. 9, 2004

(51) Int. Cl.[7] ..... E02D 5/00
(52) U.S. Cl. ..... 405/230; 405/229; 52/122.1
(58) Field of Search ..... 405/229, 230, 405/231, 232, 196, 198; 52/125.1, 125.6, 126.7, 122.1, 111; 254/264, 108

(56) References Cited

U.S. PATENT DOCUMENTS 2,992,812 A * 7/1961 Rasmussen et al. ..... 254/107
4,007,914 A * 2/1977 Sutton ..... 254/108
4,634,319 A 1/1987 May
4,854,782 A 8/1989 May
5,575,591 A * 11/1996 Vanderklaauw ..... 405/230
5,980,160 A * 11/1999 Vanderklaauw ..... 405/230
6,368,022 B1 4/2002 Zingerman

FOREIGN PATENT DOCUMENTS

JP 06212803 A * 8/1994 ..... E04G/21/16
JP 06322990 A * 11/1994 ..... E04G/21/16

* cited by examiner

*Primary Examiner*—Jong-Suk (James) Lee
*Assistant Examiner*—Lisa Saldano
(74) *Attorney, Agent, or Firm*—David Zingerman

(57) ABSTRACT

The method and system for lifting of the massive constructions provide a possibility to lift the assembled at the ground level over size and over weight objects, such as a sport arena roof with the attached columns and/or bridge section with the attached piers. An improved method for massive constructions lifting includes steps providing lifting process by at least two of a plurality of lifting supports, each of which is formed by two vertically positioned H-girders connected by their lower parts to the supporting base and coupled each to the other along their length by a plurality of strengthening (stiffening) girders. Each support includes a sling-traverse, comprising a pivoting stand, a lifting tape, the rests, and the lifting device, including the hydraulic jacks.

2 Claims, 3 Drawing Sheets

METHOD AND SYSTEM FOR LIFTING OF THE MASSIVE CONSTRUCTIONS

FIELD OF THE INVENTION

This invention relates to method and system intended to lift the massive objects (constructions) and mostly for lifting of the over size and over weight construction structures, particularly building structures such as solid roof assemblies and/or entire bridge sections and the like, which have to be lifted from their horizontal ground level initial position and to be horizontally leveled whereby the structural assembly has to be installed.

BACKGROUND OF THE INVENTION

The various types of the methods and systems for lifting of the constructions are well known. The lifting of the massive (over size) and heavy solid construction structures is a very difficult operation.

For example, the lifting system by U.S. Pat. No. 4,634,319 includes the steps of exposing the base of the structure; attaching a shoe to the base of the structure and then attaching a driving assembly to the shoe whereby the assembly may be utilized to successively and individually drive piers beneath the structure. After the piers are driven a separate pier plate unit is fitted over the end of each of the piers, which piers have been cut off at ground level. Once in place, the pier plate unit is used to support lifting means which operate between the pier plate unit and the structure to lift the structure to the desired position. After the structure has reached this position permanent, adjustable supporting means are placed between the pier plate unit and the structure whereby to retain the structure in the desired position. The apparatus for carrying out the foregoing system includes the shoe which is attached to the structure; a pier driving assembly which is carried by the shoe; a pier which is driven by the driving assembly to a point beneath the structure; a pier plate unit which is fitted over the upper end of the pier after it has been driven and its upper end cut off at ground level; lifting means which is supported by the pier plate unit; and permanent supporting means which are finally positioned between the pier plate unit and the structure for permanently supporting the structure in its desired position.

Such apparatus has the same deficiency described of the above (operates at the ground level and does not provide the structure lifting at the high levels), but is more lightweight then previous prior art.

According to another lifting method used by apparatus (U.S. Pat. No. 4,854,782), a sleeve, which acts as a means to guide the shoe and support the shoe on the pier, is placed on the pier and is adapted to mate with the shoe. In order to lift the structure, a lift bracket is attached to the shoe and a hydraulic ram or jack is inserted between the top of the sleeve and the bottom of the lift bracket. After the ram is extended to raise the structure to the desired level; pins are inserted through the shoe and shims inserted between the laterally extending plates of the sleeve and the pins driven through the shoe in order to permanently support the structure. After insertion of these permanent supports, the hydraulic ram and lift bracket may be removed and reused at a different site. The apparatus, realizing such lifting method, includes a pier, a sleeve mounted on the pier, a shoe connected to the base of a structure and mating with the sleeve, a lift bracket connected to the shoe and temporary lift means inserted between the sleeve and the lift bracket. The shoe is mated to the sleeve to allow substantially vertical movement of the shoe as the building is lifted. A hydraulic ram or jack inserted between the sleeve and the lift bracket serves as a temporary lifting means which, when extended; raises the structure to the desired position. Once in position, the building is permanently supported by securing the shoe to the sleeve. Thereafter, the ram and the lift bracket may be removed for use at a different site. A series of piers and lifting apparatus are usually required to support a single structure. The pier and the shoe are attached to the base of a structure. A sleeve, which acts as a means to guide the shoe and support the shoe on the pier, is placed on the pier and is adapted to mate with the shoe. In order to lift the structure, a lift bracket is attached to the shoe and a hydraulic ram or jack is inserted between the top of the sleeve and the bottom of the lift bracket. After the ram is extended to raise the structure to the desired level, pins are inserted through the shoe and shims inserted between the laterally extending plates of the sleeve and the pins driven through the shoe in order to permanently support the structure. After insertion of these permanent supports, the hydraulic ram and lift-bracket may be removed and reused at a different site.

Such apparatus operates at the ground level and does not provide the structure lifting at the high levels.

Another apparatus, providing the lifting of the massive, solid constructions by U.S. Pat. No. 6,368,022, comprises at least one of a plurality of lifting devices, each of which comprises at least one of a plurality of main hydraulic jacks, the major jacks, the auxiliary jacks, a pivoting stand, the supports for pivotable stand and the lifting sectional tape comprising the removable sections having the apertures for the fixing of the appropriate tape's section in its position by the locking fingers. Each lifting device also includes a upper and lower girders, sling-traverse and a pivotable stand respectively coupled to each other by bearing, and the rests.

The support is rigidly connected to each of the permanent column (for example, a column of the building such as a covered sport arena under construction, a pier of the bridge under construction or aircraft hangar, etc.) of the constructing structure. Each permanent column of the constructing building have a solid hollow configuration.

For such method and system, the permanent columns will forever comprise some of the built-in components of the lifting apparatus, which are needed for lifting only, and the assembled massive roof for a covered sport arena will be permanently leaned not on the cross-sectional square of each solid column, but only on the square of two built-in rests inside each column.

Thus, there is a great need in the art for the improved lifting method and system and system, employing at the same time a plurality of improved lifting devices operating simultaneously to lift on the assigned elevation level the already assembled massive construction structures such as sport arena roof with the hingedly attached columns to provide subsequent building build-up process under the roof

OBJECT AND ADVANTAGES OF THE INVENTION

Accordingly, several objects and advantages of the present invention are to provide the lifting of the horizontally positioned solid, massive construction structures (such as entire bridge sections and/or building structures such as solid roof assemblies and the like) on the high level.

It is another object of the invention to provide the possibility for the horizontally positioned solid, massive construction structure lifting and installation without necessity of their preliminary sectional disassembling.

It is still another object of the invention to provide the possibility to remove the lifting supports (columns) after the horizontally positioned elevated massive construction structure/roof is installed on the desired permanent supporting constructions (columns) lifted simultaneously with the roof and to reuse at a different construction site.

It is further object of the invention to provide precise and not expensive processes of lifting the massive covering construction (for example, assembled roofs) with their supporting constructions (columns), and to increase the efficiency of the construction labor.

It is still further object of the invention to reduce the time of the massive construction lifting and temporary supporting it on the desired height during the building build-up process.

Still, further objects and advantages will become apparent from a consideration of the ensuing description accompanying drawings.

DESCRIPTION OF THE DRAWING

In order that the invention and the manner in which it is to be performed may be more clearly understood, embodiments thereof will be described by way of example with reference to the attached drawings, of which.

SUMMARY OF THE INVENTION

The method and system for elevation of the massive constructions (the over size and over weight constructions) provide a possibility to lift the assembled at the ground level massive objects, for example, such as a sport arena roof. An improved method for massive constructions lifting includes steps providing lifting process by a lifting system, comprising at least two of a plurality of supports, each of which is formed by two vertically positioned H girders (in some cases, I-girders can be use too) connected by their lower parts to the supporting base and coupled each to the other along their length by a plurality of assembling strengthening (stiffening) girders. Each support includes a sling-traverse, comprising a pivoting stand, a lifting tape, the rests, and the lifting device, including the hydraulic jacks.

DESCRIPTION OF THE PREFERRED EMBODIMENTS

Here the description of an improved system will be done in statics (as if the components of the improved lifting system are suspended in the space) with description of their relative connections to each other. The description of the method and functional operations of an improved system will be done hereinafter.

Figure 1:
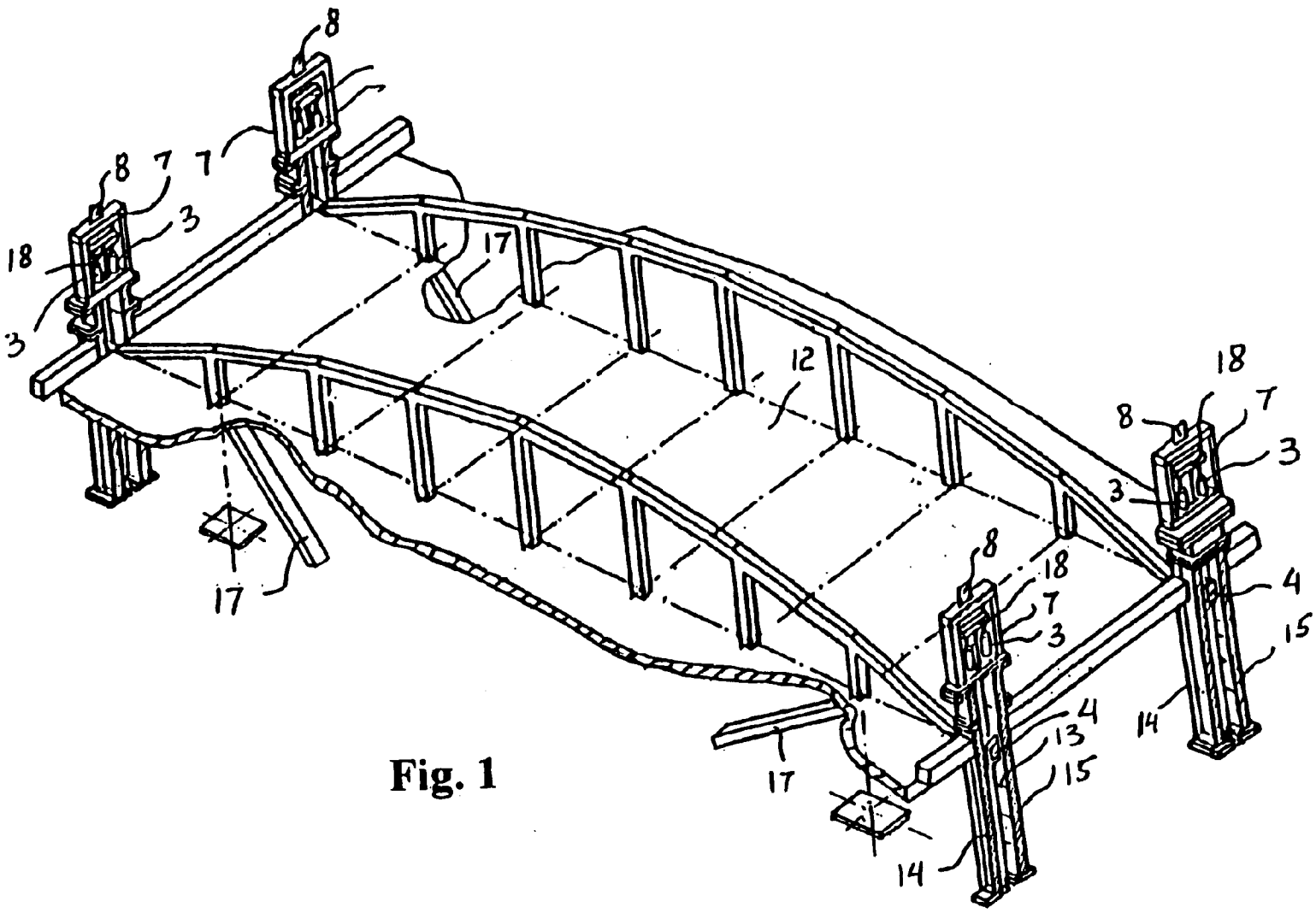
FIG. 1 is a simplified spatial view of the simultaneous lifting process by lifting supports.
Figure 2:
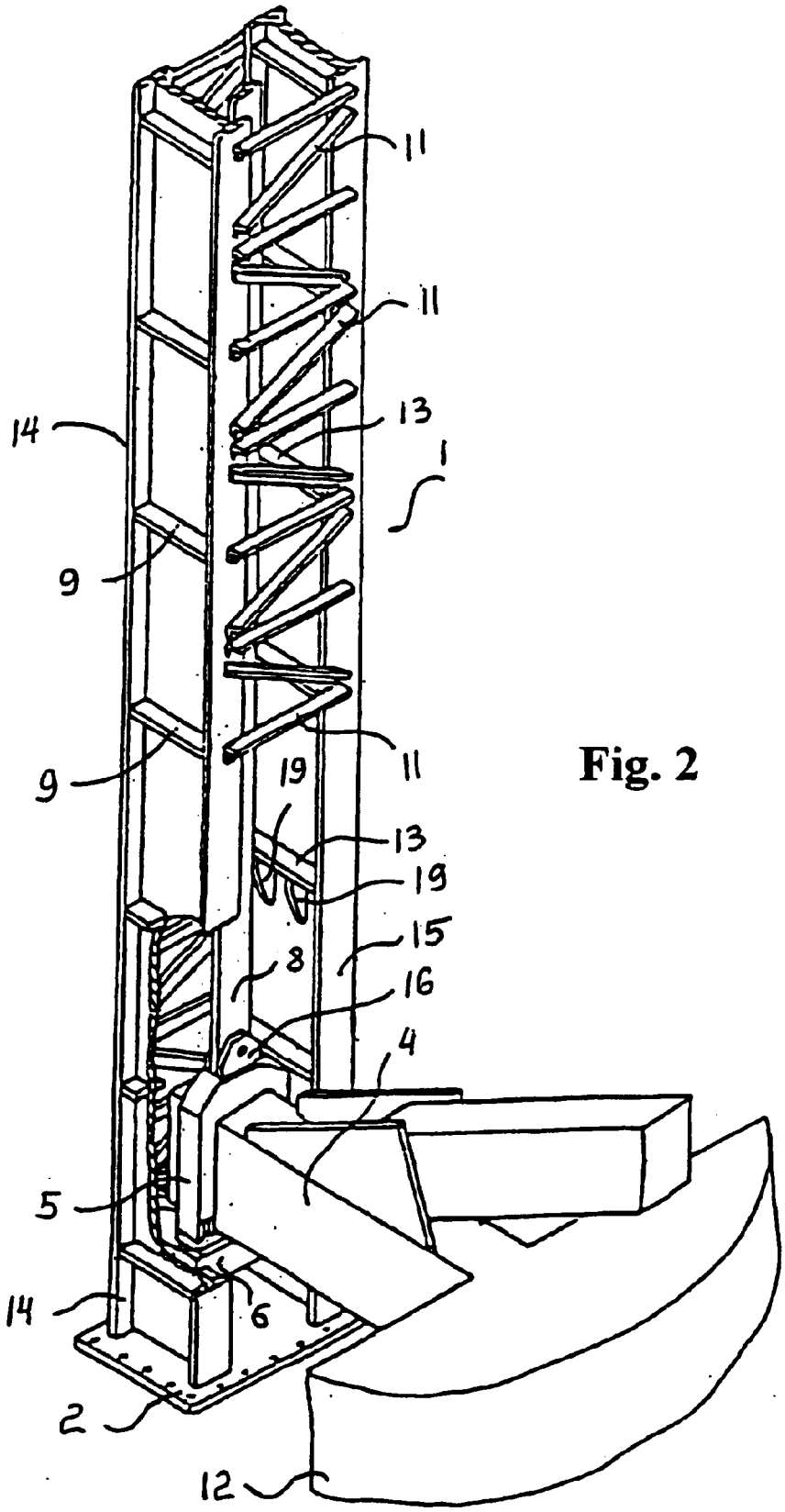
FIG. 2 is a simplified representation of the improved lifting process at the initial lifting position.
Figure 3:
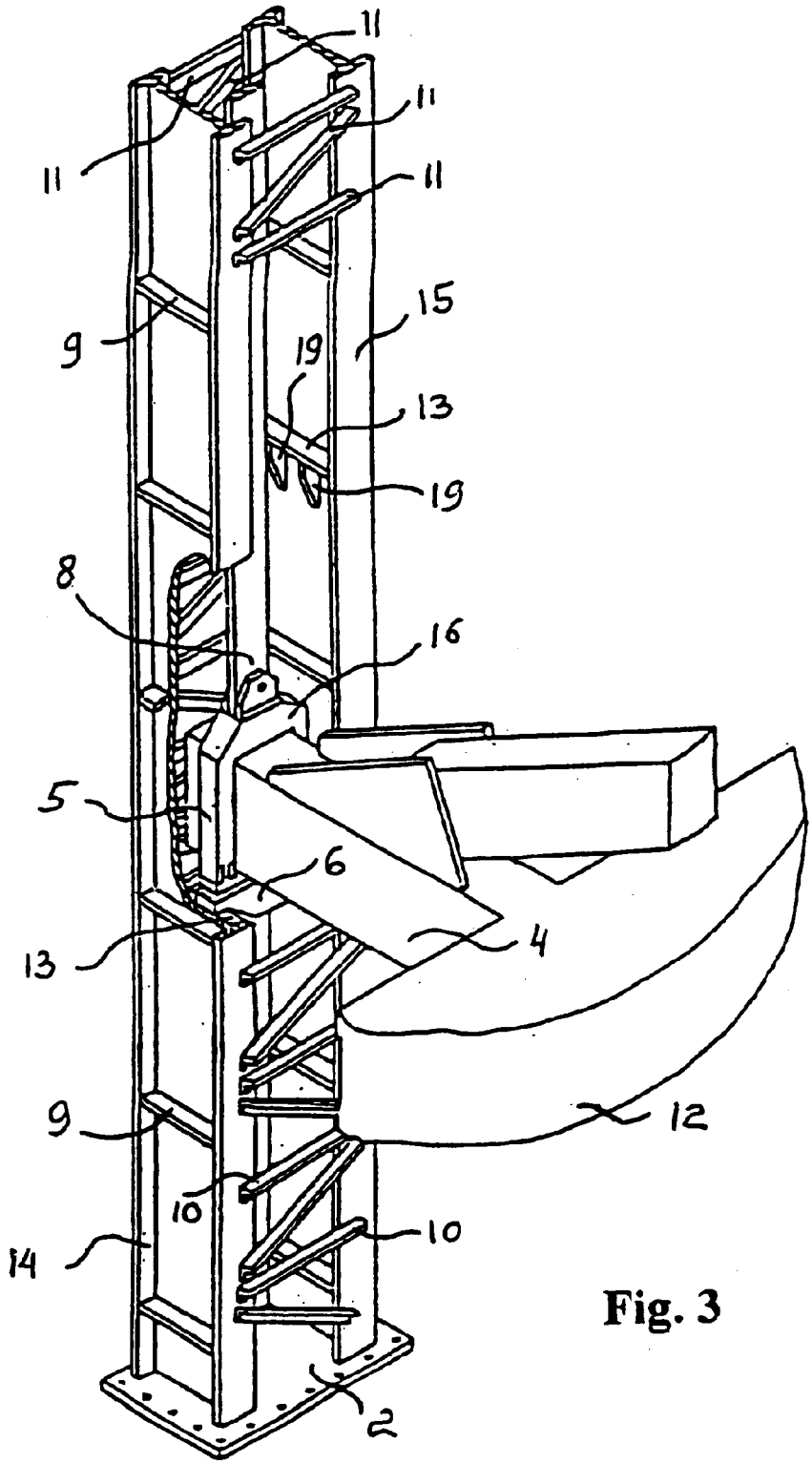
FIG. 3 is a simplified representation of the improved lifting process at the intermediate lifting position.

An improved system for lifting of a massive construction object (for example, an entire roof assembly of the sport arena building and/or the assembled bridge section) 12, comprising at least two corbels 4 and hingedly attached at least one of a plurality of columns 17, as shown on FIG. 1, includes at least two of plurality of supports 1. Each support 1 comprises a sling-traverse 5 coupled with the pivoting stand 6, as shown on FIGS. 2 and 3. The flange 16 of the sling-traverse 5 is hingedly coupled with the lowest part of the lifting tape 8, the upper part of which is coupled with the cross-girder 18 of the lifting device 7, including at least one of plurality of hydraulic jacks 3. Each support 1 is formed by at least two of plurality of H-girders rigidly installed on the appropriate base 2. On FIGS. 1–3 are shown the supports 1, formed, for example, by two H-girders 14 and 15 respectively. Each girder includes the rests 13. Also each support 1 includes the permanent 10 and the temporary strengthening girders 11.

The steps of the improved method provide lifting process as follows. In the initial stage, after the building fundament (not shown) is installed, the construction (for example, an entire roof assembly of the sport arena building and/or the assembled bridge section) 12 is assembled on the ground level exactly on fundament at the place/spot, where the construction (the object) 12 has to be lifted and installed. As shown on FIG. 1, the massive assembly 12 includes the hingedly attached columns 17, which are lifted together with the construction 12. Each corbel 4 of the assembled construction 12 (on FIG. 1, for example, the plurality of supports 1 is conditionally shown by four supports 1 for lifting of the massive assembled bridge section) is inserted into the appropriate sling-traverse 5. Each supporting base 2 is rigidly connected to fundament. Then under each corbel 4 (with the appropriate sling-traverse 5 on) can be installed fundament (not shown) for the supporting base 2. At least two H-girders (I-girders can be use too) of each support 1: the first H-girders 14 and second H-girders 15, are rigidly vertically installed by their lower parts on each appropriate supporting base 2 in such manner, that they are parallel to each other, as shown on FIGS. 1–3, and positioned with the distance between them adequate for the passage of the sling-traverse 5 with the pivoting stand 6. Each pair of the H-girders 14 and 15 forms support 1. The pivotable stand 6, coupled by bearing (not shown) with the sling-traverse 5, is leaned on the first rests 13 rigidly attached to the inner side of the first H-girders 14 and second H-girders 15. The rests 13 can be strengthened by the strengthening supports 19, as shown on FIGS. 2 and 3. Each support 1 has as much pairs of the rests 13 along H-girders 14 and 15 as the quantity of the steps (cycles) in the lifting process. On the top of each support 1, formed by the appropriate first H-girder 14 and second H-girder 15, are installed the lifting device 7, as shown in FIG. 1. The lifting tape 8 is hingedly connected by the lower its part to the flange 16 of the sling-traverse 5, as shown on FIGS. 2, 3 and connected by the upper it's side to the cross-girder 18 of the lifting device 7, as shown on FIG. 1. The mentioned connection of the lifting tape 8 with the cross girder 18 is provided at each step of the lifting process. The fixation of the lifting tape 8 and cross-girder 18 connection at each step of the lifting process can be provided by the locking finger (not shown) passing through the apertures in the lifting tape 8 (not shown) and leaning on the upper side of the cross-girder 18. The lifting tape 8 can be a metallic sectional tape, where each section is intended to pull the sling-traverse 5 during the each step of the lifting process. The sections of the tape 8 are connected to each other by the hinges (not shown) and can be removable. The tape 8 passes trough the slit (not shown) into the cross-girder 18 of the lifting device 7. The section, which is over the slit of the cross-girder 18, can be removed on each step of the lifting process.

The sections are connected to each other by the removable hinges (not shown). The length and thickness of each section is mostly the same and is calculated to provide reliability to carry the heavy construction. The lifting tape 8 is hanged on the locking finger, which is leaned on the cross-girder 18. The distance between centers of the apertures in the sections of the lifting tape 8 is the same and is adequate to the step of the hydraulic jacks 3 extension for one step of the lifting process, that is adequate the lifting sectional tape 8 elevation for one lifting cycle.

The quantity of the apertures in each section of tape 8 determines a quantity of the lifting cycles for this section and defines the length of the section. The quantity of the sections depends on the assigned height of lifting.

Also, in the initial stage, the temporary strengthening girders 11 are bolted to the first H-girder 14 and second H-girder 15 in the asymmetrical non-systematic manner shown on FIGS. 2 and 3 in order to provide "triangle strength" of the first H-girder 14 and second H-girder 15 connection, continuing to keep the parallelism of the first H-girder 14 and second H-girder 15. The connection of the first H-girder 14 and second H-girder 15 of the support 1 is provided along their length from the top of the H-girders 14 and 15 to the point, which is adequate to the length of the first (lowest) section (distance from the bottom of the pivoting stand 6 of the sling-traverse 5 at the initial position to the hinge (not shown), connecting the first and second sections of the lifting tape 8), that also corresponds to the step of the lifting process. Regarding to the each support 1, the auxiliary strengthening girders 9 can be rigidly attached to the outer sides of the H-girders 14 and 15, if necessary (FIGS. 2, 3). The pivotable stand 6 is initially positioned along sling-traverse 5 in the direction perpendicularly to the corbel 4, as shown on FIG. 2, and is leaned on the first (lowest) rests 13, as was mentioned hereinabove.

On the next step of the lifting process, the hydraulic jacks 3 lift the tape 8, thereby lifting the sling-traverse 5 with the object 12, including the columns 17 attached to the object 12 by the hinges (not shown). Somewhere, in the middle of the lifting cycle, the jacks 3 are stopped, the pivotable stand is positioned perpendicularly to the sling-traverse 5 in the direction along corbel 4 (not shown on the FIGS. 1, 2 and 3), and the lifting cycle continue. The first step of the lifting process is finished, when the pivotable stand 6 of the sling-traverse 5 is a little over the next rests 13. In this stage, the jacks 3 are stopped, the pivotable stand 6 is positioned in parallel to the sling-traverse 5 in the direction perpendicularly to the corbel 4. The valves (not shown) of each jack 3 of the lifting device 7 of each support 1 are synchronously and slightly open, and the pivotable stands 6 slowly lean on the appropriate rests 13. The upper section of the tape 8, which is over the slit (not shown) of the cross-girder 18, is removed, the locking finger is inserted into next tape's aperture, and the hydraulic jacks 3 are positioned in the initial position (no extension). The temporary strengthening girders 11, located between upper side of corbel 4 and lower part of the second section, are unbolted an taken off, and the permanent strengthening girders 10 are rigidly connected to the first H-girder 14 and the second H-girder 15 between base 2 and the lower side of the corbel 4. The housing of the permanent strengthening girders 10 is provided in the same manner, as it was above described for the temporary strengthening girders 11 (FIG. 3), and the next cycle of the lifting process can be started.

At the last lifting cycle, before the pivoting stands 6 of the sling-traverses 5 are leaned on the upper rests 13, the columns 17 can be permanently installed on the fundament, unhinged, and the lifted object 12 is leaned on the columns 17 and by pivoting stands 6 on the upper rests 13 of each support 1, if the supports 1 were not chosen to remove and will be used as the columns too.

CONCLUSION, RAMIFICATION AND SCOPE

Accordingly the reader will see that, according to the invention, I have provided the improved method and system for lifting of the massive solid/assembled constructions. The improved method and system for lifting of the massive constructions has various possibilities, considering activities of the lifting devices.

While the above description contains many specificities, these should be not construed as limitations on the scope of the invention, but as exemplification of the presently-preferred embodiments thereof. Many other ramifications are possible within the teaching to the invention. For example, the improved method and system for lifting of massive solid constructions provide simplification of the technological cycles of construction work and eliminates expensive labor for roof blocks assembling on the top of the uprisen building. The improved method and system provide decreasing of the construction build-up processes cost. Also some buildings, further intended for precise scientific researches, require the performance of all inside construction work to be done in as much as clean inside environment and a priory determined climatical conditions.

Thus, the scope of the invention should be determined by the appended claims and their legal equivalents, and not by examples given.

What is claimed is:

1. A system for lifting of massive construction object, comprising at least one of a plurality of columns, includes:

at least two of a plurality of lifting supports, each of which comprising at least two of a plurality of vertically positioned H-girders rigidly installed by their lower parts on a base, wherein said H-girders are parallel to each other; and the distance between them is adequate for a passage of a sling-traverse coupled with a pivoting stand;

at least two of a plurality of rests rigidly attached to the inner side of said the H-girders and strengthened by at least one strengthening support;

at least one of a plurality of auxiliary strengthening girders rigidly attached to the outer side of said the H-girders;

a lifting device, including a cross-girder housed in the upper part of said H-girders;

a lifting sectional tape coupled by the lowest part with a flange of said sling-traverse and by upper part with said cross-girder of said lifting device;

at least one of a plurality of temporary strengthening girders, coupling said H-girders above said flange of said sling-traverse, and wherein an appropriate quantity of said at least one of a plurality of temporary strengthening girders are removed from said H-girders above said flange of said sling-traverse after each lifting cycle providing a passage of a corbel of said massive construction object during the subsequent lifting cycle;

at least one of a plurality of permanent strengthening girders, coupling said H-girders below said pivoting stand of said sling-traverse, and wherein said at least one of a plurality of permanent strengthening girders are installed on said H-girders bellow said pivoting stand after said each lifting cycle.

2. The system of claim 1, wherein each of said at least one of a plurality of columns is hingedly coupled with said massive construction object.

* * * * *